US007452321B2

(12) United States Patent
Kauppila

(10) Patent No.: US 7,452,321 B2
(45) Date of Patent: Nov. 18, 2008

(54) HIGH SPEED INTERFOLDER

(75) Inventor: Greg Kauppila, Ashland, WI (US)

(73) Assignee: C.G. Bretting Manufacturing Company, Inc., Ashland, WI (US)

( * ) Notice: Subject to any disclaimer, the term of this patent is extended or adjusted under 35 U.S.C. 154(b) by 39 days.

(21) Appl. No.: 11/246,993

(22) Filed: Oct. 7, 2005

(65) Prior Publication Data

US 2007/0082800 A1 Apr. 12, 2007

(51) Int. Cl.
*B31F 1/10* (2006.01)

(52) U.S. Cl. ..... 493/418; 493/359; 493/430; 493/433; 270/39.01; 270/40; 270/39.05

(58) Field of Classification Search ..... 493/359, 493/418, 430, 433; 270/39.01, 40, 39.05, 270/39.06, 39.07
See application file for complete search history.

(56) References Cited

U.S. PATENT DOCUMENTS

| | | | | |
|---|---|---|---|---|
| 1,713,016 | A | 5/1929 | Zuckerman | |
| 1,886,312 | A | 11/1932 | Stanton | |
| 2,077,878 | A | 4/1937 | Fairchild | |
| 2,092,952 | A | 9/1937 | Campbell | |
| 3,338,575 | A | 8/1967 | Nystrand | |
| 3,489,406 | A | 1/1970 | Nystrand | |
| 3,490,762 | A | 1/1970 | Nystrand | |
| 3,572,681 | A | 3/1971 | Nystrand | |
| 4,163,548 | A | 8/1979 | Nystrand | |
| 4,254,947 | A | 3/1981 | Trogan | |
| 4,279,411 | A | 7/1981 | Nystrand | |
| 4,521,209 | A | 6/1985 | DuFresne | |
| 5,147,273 | A * | 9/1992 | Rottmann et al. | 493/349 |
| 5,310,398 | A * | 5/1994 | Yoneyama | 493/430 |
| 5,980,444 | A | 11/1999 | Dickhoff | |
| 6,090,467 | A | 7/2000 | Yip | |
| 7,121,994 | B2 * | 10/2006 | Haasl | 493/442 |
| 2005/0073090 | A1 | 4/2005 | White | |

FOREIGN PATENT DOCUMENTS

| | | |
|---|---|---|
| EP | 1 520 822 | 6/2005 |
| JP | 57160865 | 10/1982 |

* cited by examiner

*Primary Examiner*—Hemant M Desai
(74) *Attorney, Agent, or Firm*—Reinhart Boerner Van Deuren P.C.

(57) ABSTRACT

An interfolding apparatus including a knife roll rotatable about an axis and operable to cut successive sheets from a stream of web material issuing from a source in a downstream direction. A folding roll is positioned downstream of the knife roll and is rotatable in a first direction at a first roll speed. An additional roll is disposed adjacent to the folding roll and is rotatable about an axis in a second direction at a second roll speed. The additional roll is operable to receive the successive sheets and release the successive sheets in the downstream direction toward the folding roll. The folding roll and the additional roll define a nip therebetween, the successive sheets passing through the nip. The first roll speed of the folding roll is different from the second roll speed of the additional roll, the difference in speed between the folding roll and the additional roll operable to overlap adjacent portions of the successive sheets onto the folding roll.

36 Claims, 11 Drawing Sheets

HIGH SPEED INTERFOLDER

BACKGROUND

The present invention relates to interfolding methods and apparatuses, and more specifically to the transfer of sheets onto interfolding rolls of the interfolding methods and apparatuses.

Various combinations and types of rolls can be present in an interfolding apparatus. A typical interfolding apparatus includes at least two interfolding rolls, at least one knife or cutting roll, and at least one feed roll for pulling streams of web material into the interfolding apparatus. The web material is generally cut at or near the knife rolls and then travels to a bed roll, which may include a vacuum to help guide the web through its path. From the bed roll, the web travels to a lap roll to overlap the sheets, which are eventually transferred to a nip between the interfolding rolls.

In known interfolder designs where a multi-fold stack of sheets is desired (e.g., sheets that include two folds, forming three panels, where the third panel of one sheet is interfolded with the first panel of another sheet), the lap roll drives the web of sheets to a slow-down roll that travels at a speed ⅓ slower than the speed of the lap roll. The slow down roll delays the movement of a sheet to allow the next consecutive sheet to overlap the trailing ⅓ of the first sheet. Thus, in the known interfolders, the transfer and overlap of the sheets is done at an intermediate station before the overlapped sheets are transferred to the folding rolls. The addition of the slow down roll adds to the overall size, expense, and complexity of the interfolder. It is thus desirable to provide an interfolder capable of forming multi-fold stacks of sheets that is more compact, simpler to operate, and simpler to manufacture.

SUMMARY

Some embodiments of the invention provide an interfolding apparatus and a method of interfolding sheets of web material that improves the configuration and operation of the interfolding apparatus.

In one embodiment, the invention provides an interfolding apparatus including a knife roll rotatable about an axis and operable to cut successive sheets from a stream of web material issuing from a source in a downstream direction. A folding roll is positioned downstream of the knife roll, the folding roll rotatable in a first direction at a first roll speed. An adjacent roll is disposed adjacent to the folding roll and is rotatable about an axis in a second direction at a second roll speed. The additional roll is operable to receive the successive sheets and release the successive sheets in the downstream direction toward the folding roll. The folding roll and the additional roll define a nip therebetween, the successive sheets passing through the nip. The first roll speed of the folding roll is different from the second roll speed of the additional roll, the difference in speed between the folding roll and the additional roll operable to overlap adjacent portions of the successive sheets onto the folding roll.

In another embodiment, the invention provides a method of interfolding sheets of web material. The method includes issuing web material in a downstream direction from a source, cutting with a knife roll the stream of web material into successive sheets, rotating an additional roll at a first roll speed, and transferring each sheet to the additional roll. The method further includes rotating a folding roll at a second roll speed, transferring each sheet to the folding roll, slowing the sheet with the folding roll, overlapping adjacent portions of the successive sheets onto the folding roll, and interfolding the overlapped sheets.

In another embodiment, the invention provides an interfolding apparatus comprising a knife roll rotatable about an axis and operable to cut sheets from a stream of web material issuing from a source in a downstream direction, and a folding roll positioned downstream of the knife roll and adapted to receive the sheets, the folding roll rotatable in a first direction. A lap roll is adjacent the folding roll that is rotatable about an axis in a second direction, the lap and folding roll defining a nip therebetween. The sheets are directly transferred from the lap roll to the folding roll to overlap adjacent portions of successive sheets onto the folding roll.

In another embodiment, the invention provides a method of interfolding sheets including issuing web material in a downstream direction from a source, cutting with a knife roll the stream of web material into sheets, transferring each sheet to a rotating lap roll, and transferring each sheet directly from the lap roll to a rotating folding roll. Some embodiments include overlapping a trailing edge of a first sheet with a leading edge of a second successive sheet on the folding roll, and interfolding the overlapped sheets.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
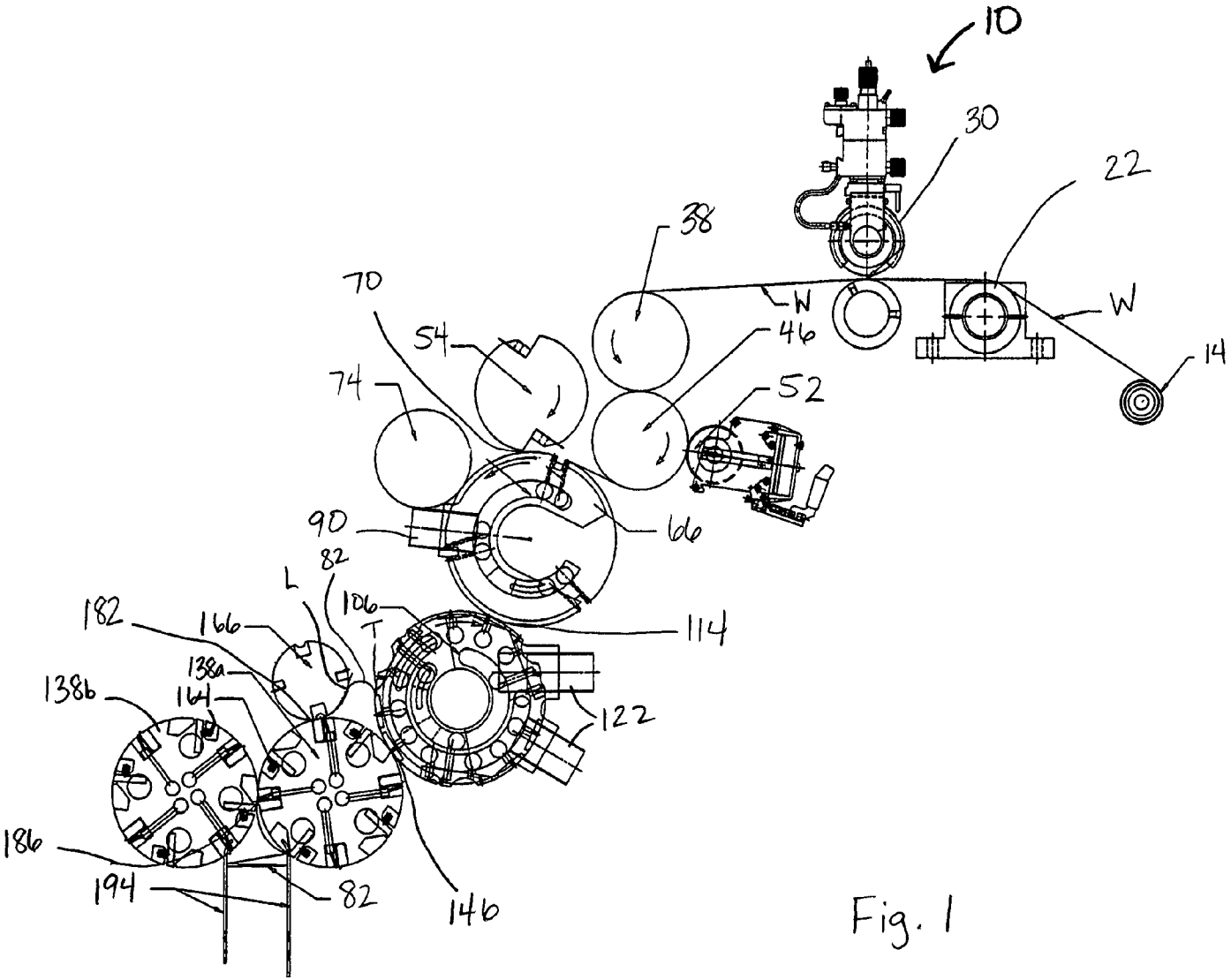
FIG. 1 is a side view illustrating an interfolding apparatus of one embodiment of the present invention.
Figure 2:
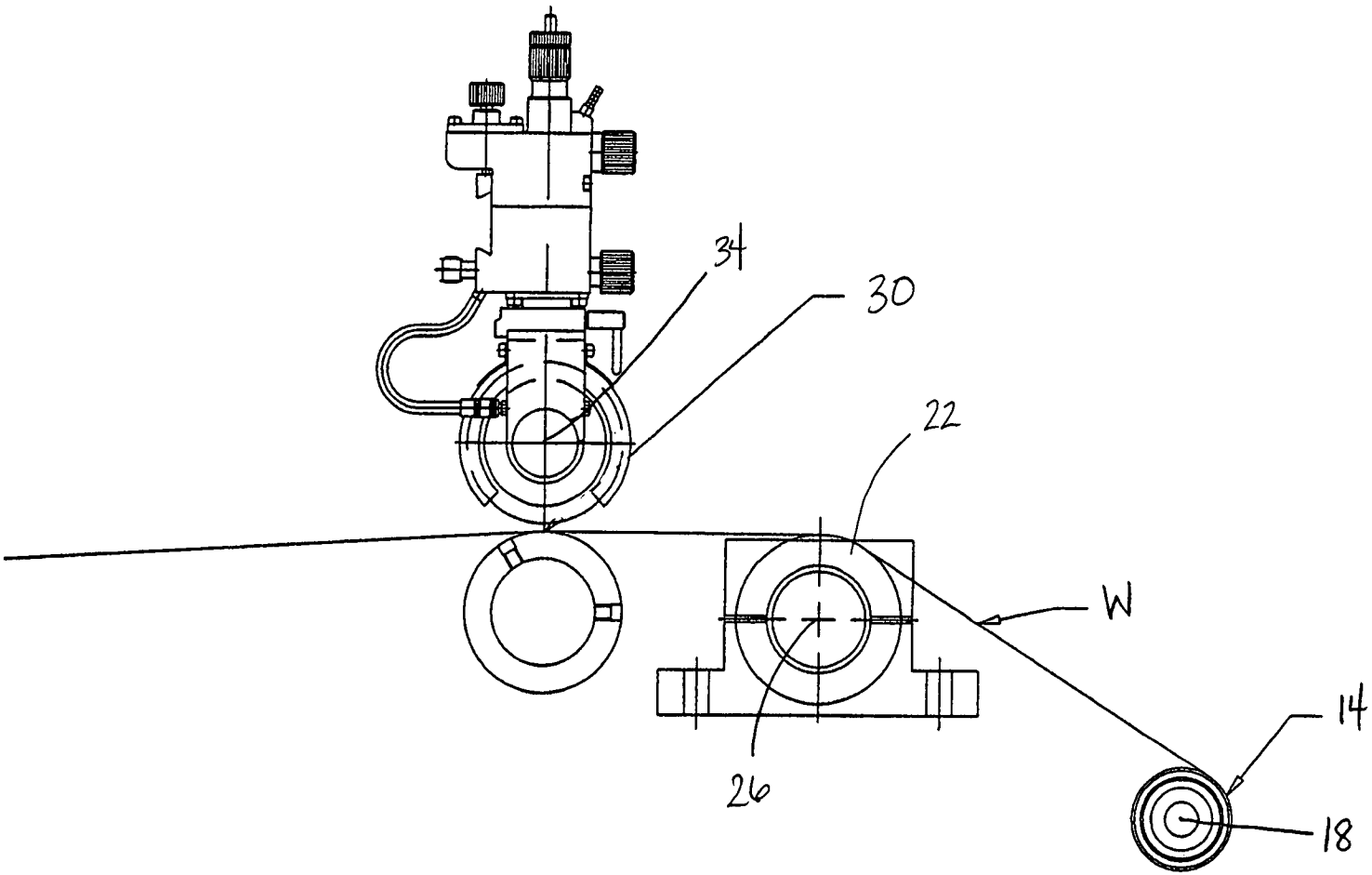
FIG. 2 is an enlarged side view of a portion of the interfolding apparatus of FIG. 1, illustrating the slitter roll.

An interfolder, or interfolding apparatus 10, of one embodiment of the present invention is illustrated in FIG. 1. As shown in FIGS. 1 and 2, the interfolding apparatus 10 includes an idler roll 14 that is mounted for rotation about an axis 18. A bowed roll 22 is mounted for rotation about an axis 26, and a slitter roll 30 is mounted for rotation about an axis 34. As a web W of paper or other substrate passes through the interfolding apparatus 10, the bowed roll 22 removes the wrinkles from the web W, and the slitter roll trims the web W to the desired web width.

Figure 3:
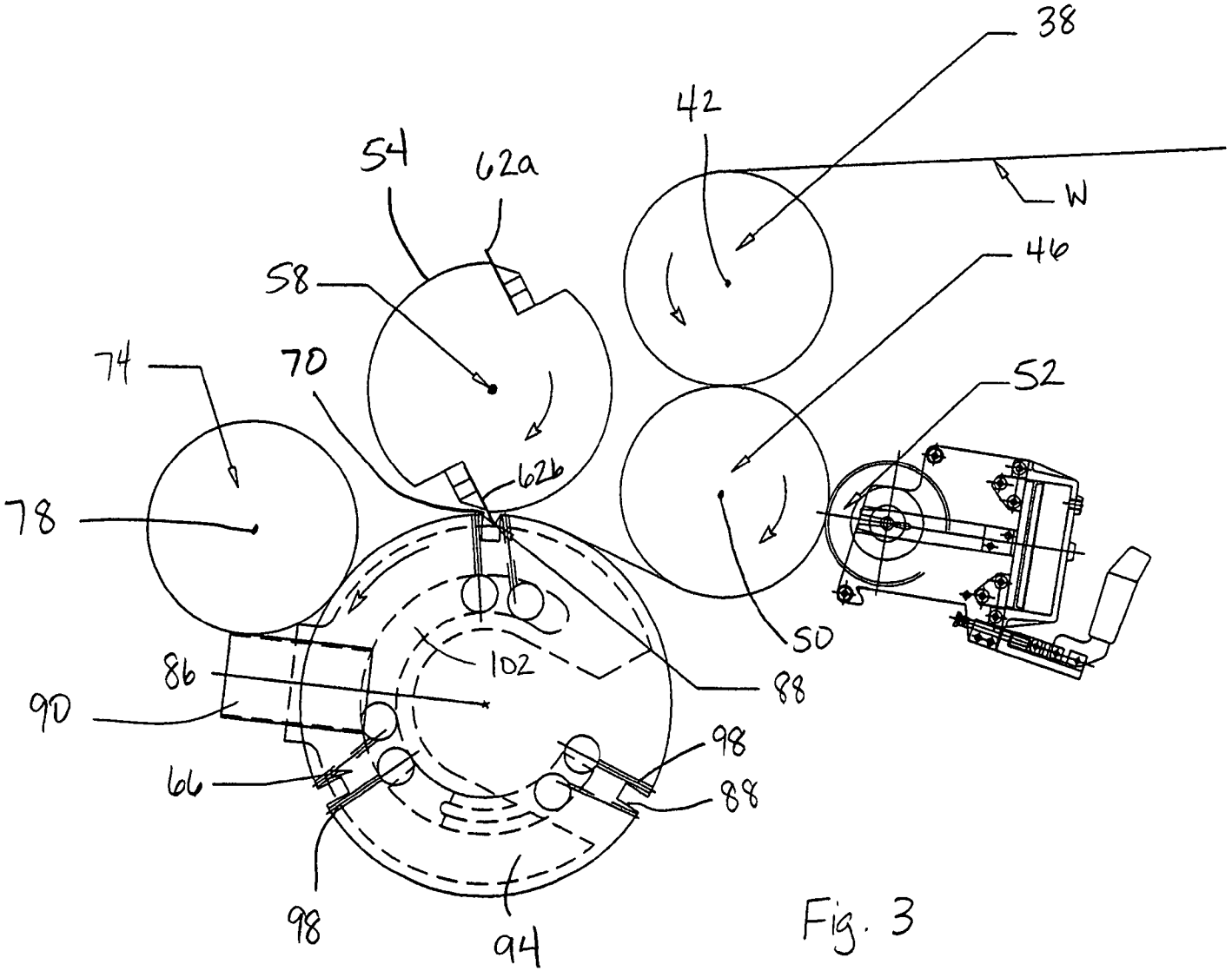
FIG. 3 is an enlarged side view of a portion of the interfolding apparatus of FIG. 1, illustrating the knife roll.

As shown in FIGS. 1 and 3, the interfolding apparatus includes a first pull roll 38 that is mounted for rotation about an axis 42, and a second pull roll 46 adjacent the first pull roll 38 mounted for rotation about an axis 50. In the illustrated embodiment, the first pull roll 38 is adjustable, which helps direct the web W to the second pull roll 46. The second pull roll 46 in the illustrated embodiment is a fixed roll. It should be understood that in other embodiments, the first pull roll can be a fixed roll, the second pull roll can be adjustable, both rolls can be fixed, or both rolls can be adjustable and still fall within the scope of the present invention. A slitter roll 52 is mounted adjacent the second pull roll 46.

A knife roll 54 is mounted for rotation about an axis 58. The knife roll 54 contains blades 62*a*, 62*b* that cooperate with a bed roll 66, as will be described in detail below. The knife roll 54 and bed roll 66 are adjacent each other and form a nip 70 therebetween. A pressure roll 74 is mounted adjacent the knife roll 54 for rotation about an axis 78.

In the embodiment illustrated in FIGS. 1 and 3, the knife roll 54 includes two blades 62*a*, 62*b*, though any number of blades can be used. The distance between the blades 62*a*, 62*b* corresponds to the length of a sheet 82 cut from the stream of web material W. In other words, the sheet 82 extends across a circumferential length that is equal to ½ of the circumference of the knife roll 54. A circumferential length is defined as the length of the portion of the roll circumference between leading and trailing edges of the sheet assuming that the roll radius is continuous and disregarding any non-uniformities on the roll surface, such as protuberances or grooves.

The bed roll 66 is mounted for rotation about an axis 86. The bed roll includes recesses 88 in the surface thereof for cooperating with the blades 62*a*, 62*b* of the knife roll 54. The bed roll 66 also includes a vacuum source 90 and a vacuum valve 94 operable to open and close vacuum ports 98 located on either side of the recesses 88 for controlling the web W as it passes through the first nip 70. In some embodiments, the vacuum valve 94 includes adjustable slides 102 for controlling the application of the vacuum.

Figure 4:
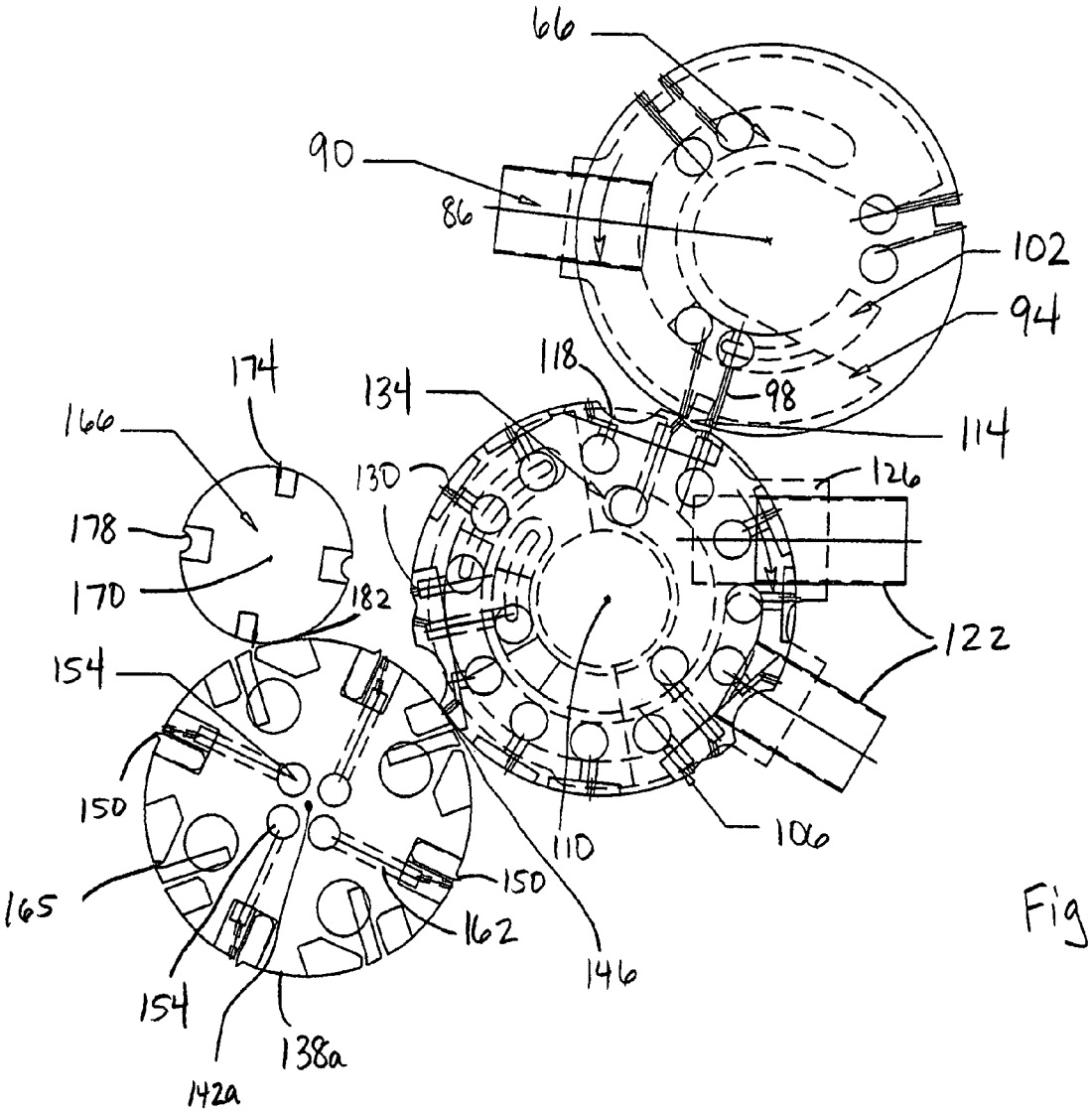
FIG. 4 is an enlarged side view of a portion of the interfolding apparatus of FIG. 1, illustrating the lap roll and the folding roll.

Referring now to FIGS. 1 and 4, a lap roll 106 is mounted adjacent the bed roll 66 for rotation about an axis 110. The bed roll 66 and the lap roll 106 form a nip 114 therebetween. The lap roll 106 rotates at a lap roll speed. It should be understood that when this application refers to the speed of any one of the rolls, the speed referred to is the peripheral speed at the perimeter of the rolls. Given that different rolls have different diameters and different circumferences, two rolls rotating at the same overall rotational velocity can have very different peripheral speeds due to the size of the roll. Thus, any reference to roll speed in this application refers to the peripheral speed at an outer circumferential edge of the roll.

The lap roll 106 includes relief areas 118 in the surface thereof, the function of which will be described in detail below. The relief areas 118 of the illustrated embodiment are formed by a separate curved plate inset into the surface of the lap roll 106, though the relief areas 118 can be integrally formed with the lap roll 106. The lap roll 106 also includes a vacuum source 122, vacuum valves 126, and vacuum ports 130 positioned about the circumference of the lap roll 106. As with the bed roll 66, in some embodiments, the lap roll 106 vacuum valves 126 include adjustable slides 134 for controlling the application of the vacuum.

Figure 10:
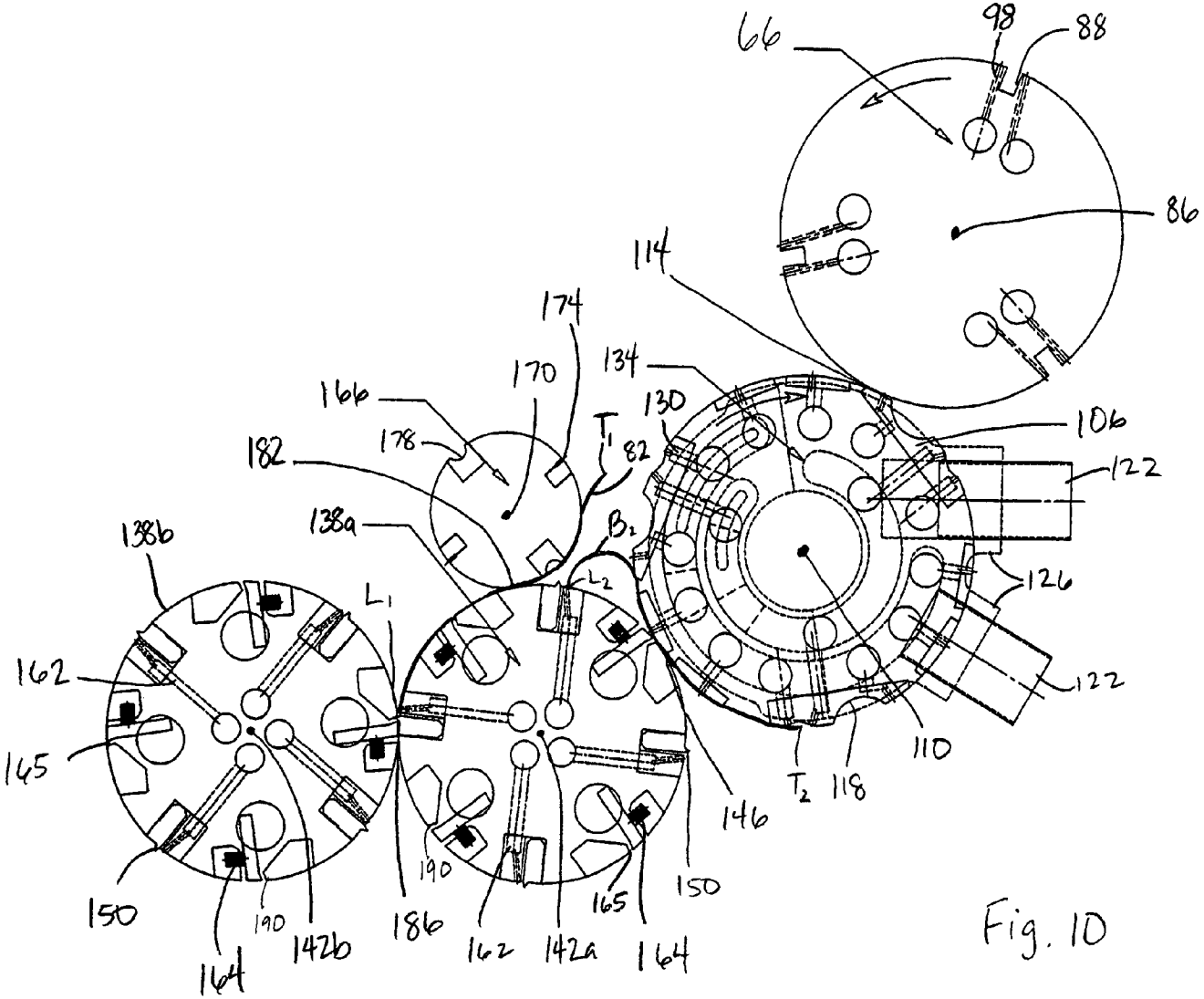
Figure 11:
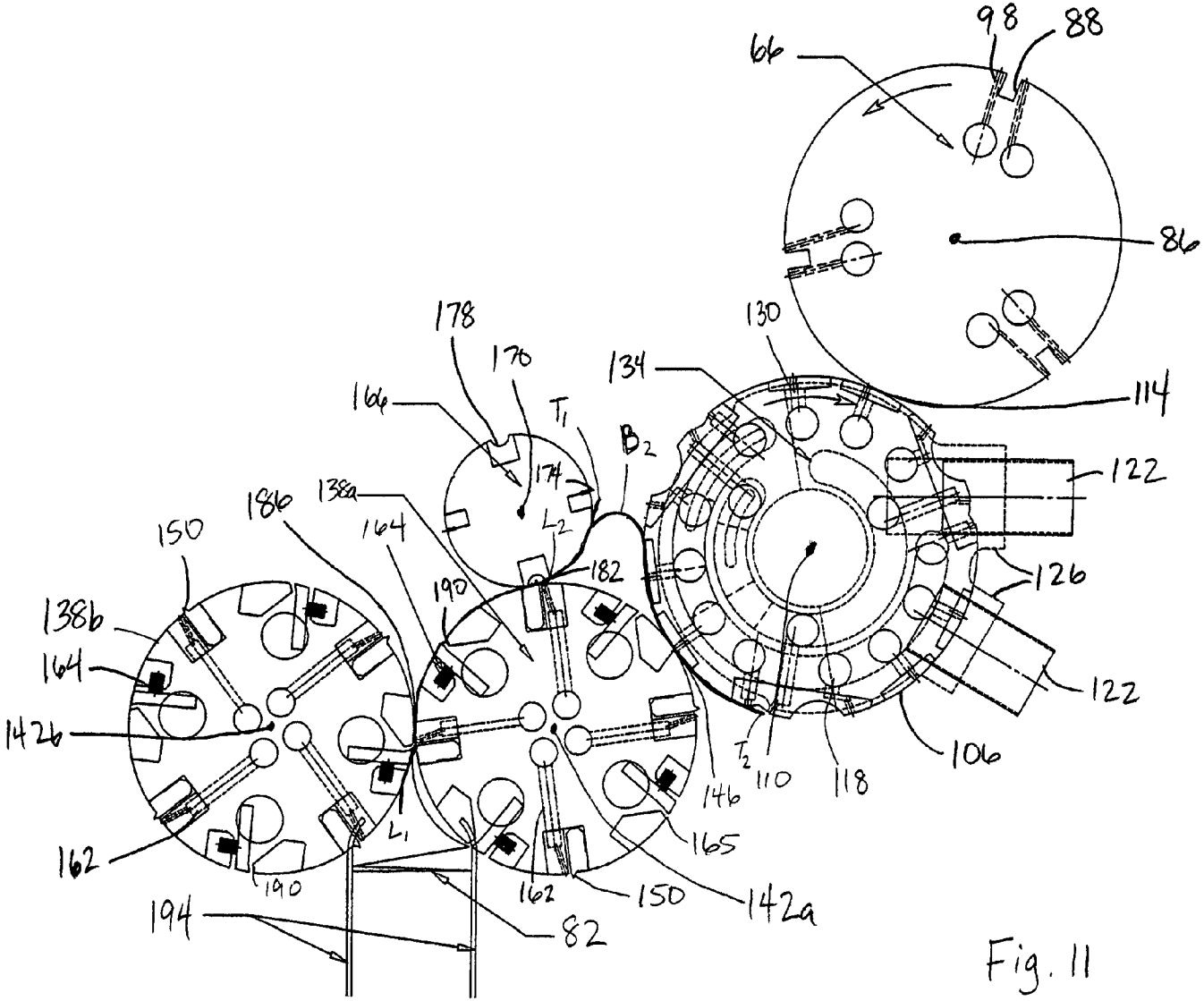

Folding rolls 138*a*, 138*b* are mounted about axes 142*a*, 142*b* (see FIG. 1). The folding roll 138*a* and lap roll 106 form a nip 146 therebetween. The folding rolls 138*a*, 138*b* rotate such that the folding rolls 138*a*, 138*b* have a lower peripheral speed than the lap roll 106; The folding roll 138*a* includes tuckers 150 that extend outwardly from the outer surface of the folding roll 138*a*, the function of which will be described in detail below. In the illustrated embodiment, four tuckers 150 are utilized by the folding roll 138*a*, though any number of tuckers can be used and still fall within the scope of the present invention. The folding rolls 138*a*. 138*b* include vacuum valves 154 that selectively supply vacuum to vacuum ports 162 located adjacent to the tuckers 150. As shown in FIGS. 1, 10, and 11, the folding rolls 138*a*, 138*b* include mechanical grippers 164. The grippers 164 of the illustrated embodiment are spring-loaded mechanical grippers, though any type of grippers, including vacuum grippers, can be used and still fall within the scope of the present invention. Four grippers 164 are utilized by the folding rolls 138*a*, 138*b* of the illustrated embodiment, though any number of grippers can be used. Recesses 165 are located within the surface of the folding rolls 138*a*, 138*b* adjacent the grippers 164. The folding rolls 138*a*, 138*b* of the illustrated embodiment are each a single roll that extends across the width of the interfolding apparatus 10, though in other embodiments, the folding rolls can each include a series of rolls extending across the width of the interfolding apparatus 10.

A tail roll 166 is mounted adjacent the folding roll 138*a* for rotation about an axis 170. The tail roll 166 includes tail roll tuckers 174 extending outwardly from the outer surface of the tail roll 166, and relief areas 178 for receiving a portion of a sheet 82, as will be described in detail below. The tail roll 166 and folding roll 138 define a nip 182 therebetween. While the tail roll 166 of the illustrated embodiment is a rotatable roll, in other embodiments the tail roll could be a fixed guide. In other embodiments, the fixed tail roll is preferably curved.

The operation of the interfolding apparatus 10 described above will now be described in detail. As shown in FIG. 2, a of web material W is fed from paper feeds (not shown) into a rear portion of the interfolding apparatus 10. The web W is transferred over the bowed roll 22 to remove any wrinkles from the web W. The web W then passes over the driven slitter roll 30 which trims the web W to the desired width.

Once the web W is slit to the desired width, the web W passes over the first pull roll 38, which travels in a counterclockwise direction about the axis 42 to draw the web W toward the second pull roll 46, as is shown in FIG. 3. The second pull roll 46 rotates in the clockwise direction about the axis 50 to pull the web W inwardly to the nip 70 between the knife roll 54 and bed roll 66. If the web W is to be slit into smaller web widths, the slitter 52 cuts the web W into the smaller widths against the second pull roll 46, and the web W passes to the knife roll 54. Other methods and arrangements are suitable for transferring streams of web material to the knife rolls, as is well known to one of ordinary skill in the art.

Figure 5:
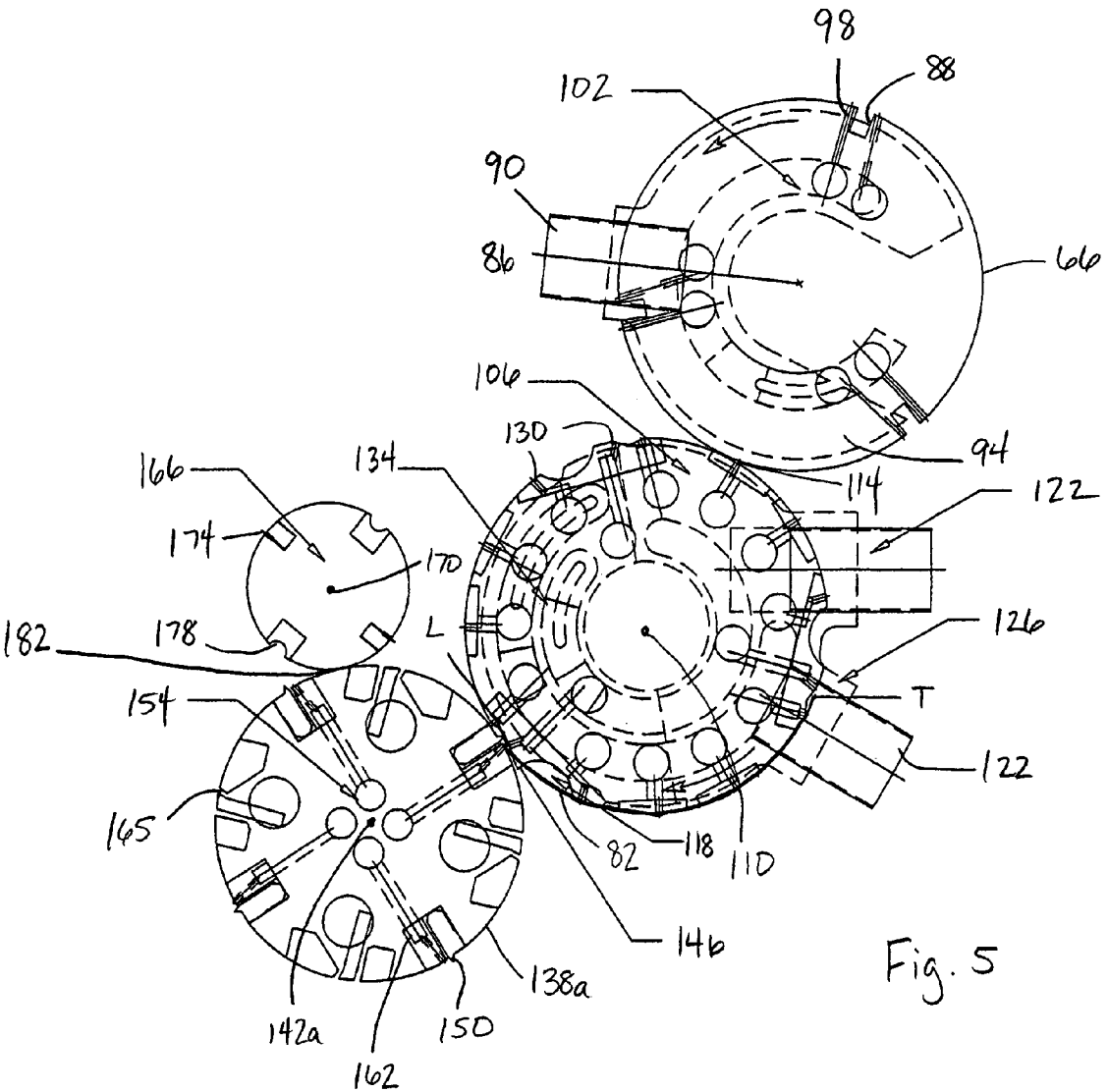
FIGS. 5-11 are detail views of the interfolding apparatus of FIG. 1, illustrating the interfolding apparatus in operation.

As shown in FIG. 3, when transferred to the nip 70, a sheet 82 is cut from the web material W when the blade 62*b* interacts with the recess 88 on the bed roll 66. Other methods and arrangements are available for cutting streams of web material into sheets on a knife roll, as is well known to one of ordinary skill in the art. For clarity, only one sheet 82 is shown in FIGS. 3-5. In general, for the illustrated embodiment, adjacent sheets of web material cut by the knife roll 54 are present on the upstream and downstream sides of the sheet 82. The knife roll 54 successively cuts sheets from the web material W with the blades 62*a*, 62*b*.

As the web W enters the nip 70, the vacuum valves 94 turn on the vacuum ports 98 in the bed roll 66. The vacuum applied to the web W assists in carrying the sheet 82 around the bed roll 66 to the pressure roll 74. The pressure roll 74 helps pinch the sheet 82 to the bed roll 66 to keep the sheet 82 from backing up (i.e., the pressure roll 74 keeps the web taught), and allows the web W passing through the nip 70 to be cut to the desired sheet length.

As shown in FIG. 4, the bed roll 66 rotates about the axis 86 in the counterclockwise direction to move the sheet 82 to the lap roll 106. The vacuum applied through the vacuum ports 98 carries the sheet 82 to the nip 114 formed between the bed roll 66 and lap roll 106. The vacuum valves 126 of the lap roll 106 turns on, applying vacuum to the vacuum ports 130 as the vacuum of the bed roll 66 turns off. This vacuum transfer can be adjusted with the adjustable slides 102, 134 of the bed roll 66 and lap roll 106, respectively.

With reference to FIG. 5, after the vacuum of the lap roll 106 picks up the leading cut edge L of the sheet 82, the clockwise rotation of the lap roll 106 about the axis 110 carries the sheet 82 to the nip 146 formed between the lap roll 106 and folding roll 138*a*. As the sheet 82 enters the nip 146, the vacuum valves 154 in the folding roll 138*a* turn on, supplying vacuum to the vacuum ports 162, such that the vacuum port 162 holds the leading edge L of the sheet 82 against the folding roll 138*a*. The vacuum holding the leading edge L of the sheet 82 against the folding roll 138*a* moves the sheet 82 in the counterclockwise direction with the folding roll 138*a* toward the tail roll 166. The leading edge L of the sheet 82 is directly transferred from the lap roll 106 to the folding roll 138*a*.

As shown in the illustrated embodiment, the folding roll 138*a* is traveling at approximately ⅔ the speed of the lap roll 106 and thus the folding roll 138*a* slows the speed of the sheet 82 as the sheet 82 passes through the nip 146. More specifically, the slower speed of the folding roll 138*a* causes the leading edge L of the sheet 82 to slow as the sheet passes through the nip 146. The vacuum of the lap roll 106 retains a trailing portion of the sheet 82 against the lap roll 106 as the sheet 82 moves through the nip 146, including a trailing edge T of the sheet 82. Thus, the trailing edge T is moving at the faster speed of the lap roll 106.

Figure 6:
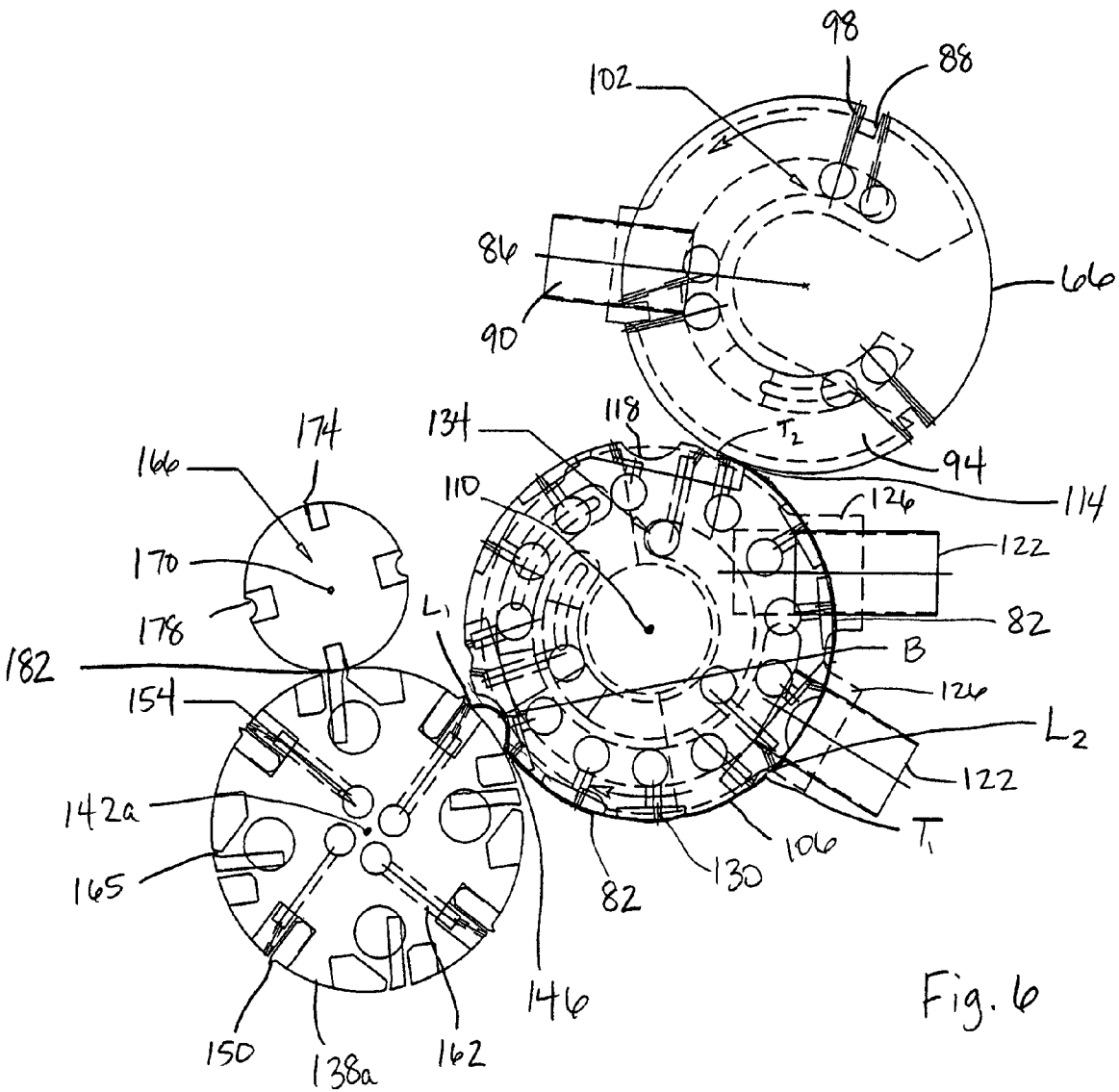

As shown in FIG. 6, the slower speed of the leading edge $L_1$ relative to the trailing edge $T_1$ causes a bubble B of excess paper to form in the sheet 82. This bubble B is accommodated by the relief areas 118 in the surface of the lap roll 106 as the sheet 82 finishes traveling through the third nip 146. The slowing down of the sheet 82 and the creation of the bubble $B_1$ allows for a ⅓ overlap between the trailing edge $T_1$ of the first sheet 82, and the leading edge $L_2$ of a successive sheet 82. In other embodiments of the invention, especially where a different amount of overlap between the sheets is desired, the folding roll 138*a* can travel at different speeds with respect to the lap roll 106 and still fall within the scope of the present invention. As shown in FIGS. 6-11, the next successive sheet 82 follows immediately after the first sheet 82.

As mentioned above, conventional interfolding devices can create overlapping sheets. However, the conventional interfolding devices that rely upon a change in speed in the rolls of the interfolder utilize a separate slowdown or transfer roll that slows the sheets for the purposes of allowing overlap between successive sheets, and then passes the sheets to the folding roll or rolls. This additional intermediate roll or transfer station adds to the overall size, complexity, and expense of the interfolder. The interfolding apparatus 10 of the present invention is more compact, less expensive, and simpler to operate by eliminating the need for a separate slowdown roll or transfer station.

Figure 7:
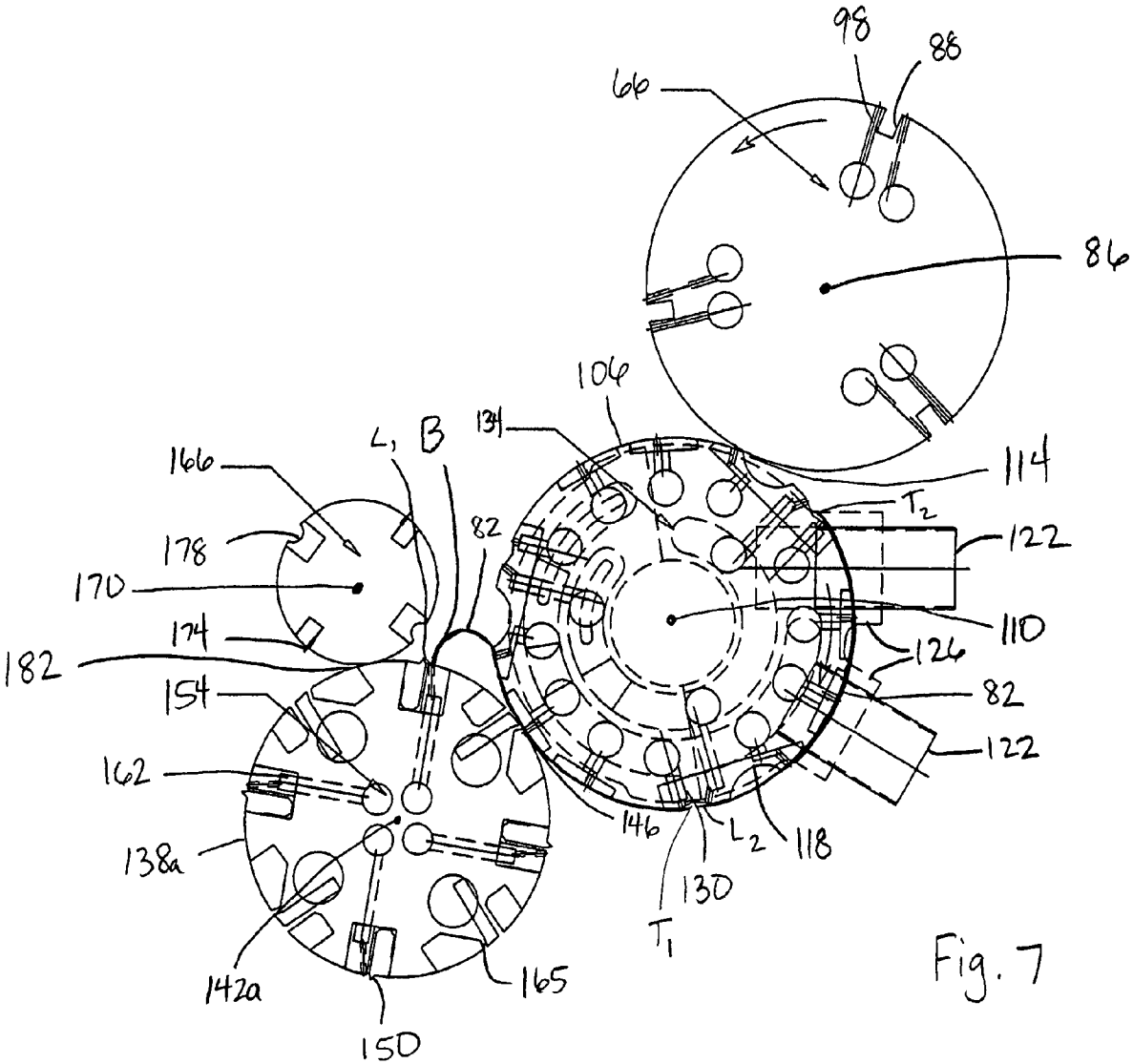
Figure 8:
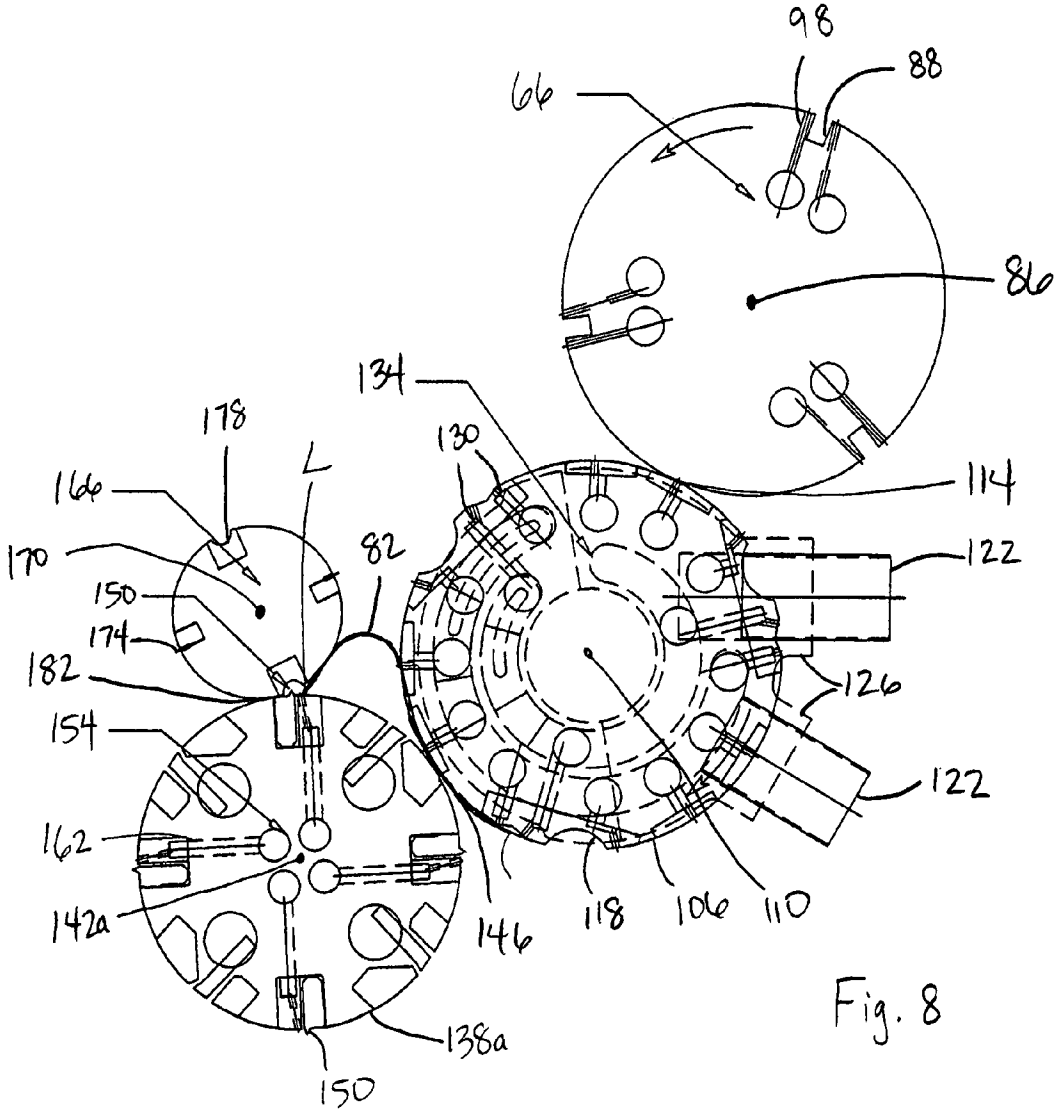
Figure 9:
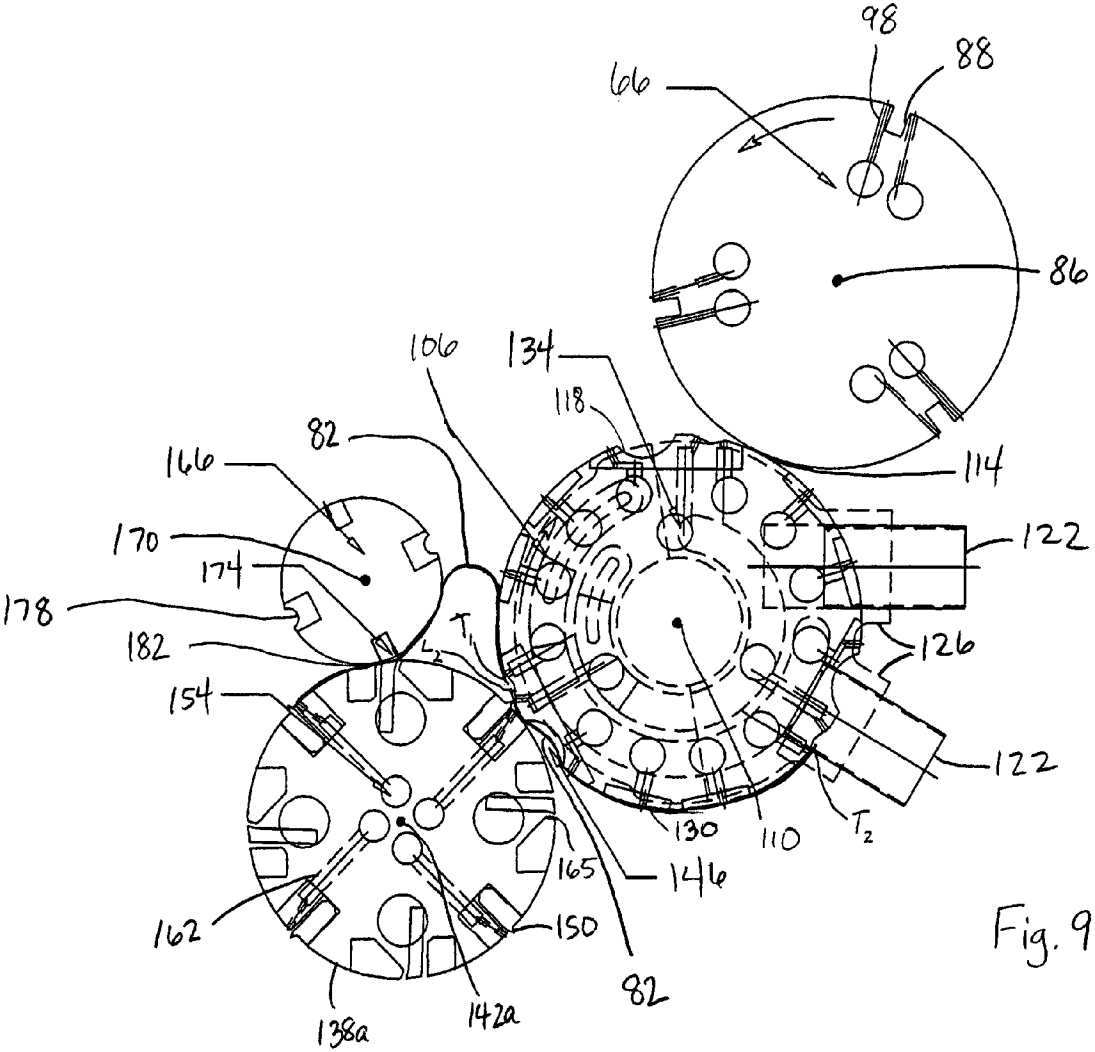

Referring now to FIGS. 7 and 8, the vacuum of the folding roll 138*a* carries the sheet 82 around the folding roll 138*a* in the counterclockwise direction to the nip 182 formed between the folding roll 138*a* and the tail roll 166, freeing the bubble B in the sheet 82 from the relief area 118 of the lap roll 106. As the trailing cut edge $T_1$ leaves the nip 146, the vacuum of the lap roll 106 holds the edge $T_1$ on the lap roll 106 approximately thirty degrees past the nip 146, as shown in FIG. 9. Additional vacuum ports 130 retain the portion of the sheet extending between the bubble $B_1$ and the trailing edge $T_1$ against the lap roll 106, with the sheet, in effect, peeling away from the lap roll 106 as the leading edge $L_1$ moves through the nip 182. This allows the leading edge $L_2$ of the next successive sheet 82 to catch up and slide under the previous sheet 82 by approximately ⅓ the length of the sheet 82. The tuckers 174 of the tail roll 166 pretuck the sheet 82 into the recesses 165 in the folding roll 138*a*. The pretucking of the sheet 82 provides extra paper as the sheet 82 travels between the folding rolls 138*a*, 138*b* to allow the sheet 82 to be folded. The relief areas 178 on the tail roll 166 also allow for clearance of the tuckers 150 of the folding roll 138*a*.

As shown in FIGS. 10 and 11, the sheet 82 is now passed into a nip 186 between the first and second folding rolls 138*a*, 138*b*. In the illustrated embodiment, the first folding roll 138*a* is a movable roll, and the second folding roll 138*b* is a fixed roll. As the sheet 82 moves into the fifth nip 186, the tuckers 150 of the folding roll 138*a* tuck the sheet into the mechanical grippers 164 in the folding roll 138*b*, and vice versa. The grippers 164 are controlled by a cam follower (not shown) that rides on a cam (also not shown), and utilizes springs to close the gripper 164. The sheet 82 is then pushed onto an anvil 190 to create a fold in the sheet 82. As the sheet 82 is folded by the folding rolls 138*a*, 138*b*, the sheet 82 is carried down to web guides 194 where the gripper 164 will open and release a folded product. In other embodiments, other means, such as belts, vacuum, etc., can be used in the grippers to transfer and fold the sheets. As sheets continue to progress through the interfolding apparatus 10, the folding rolls 138*a*, 138*b* continue to interfold sheets of material in the manner described above.

Various features of the invention are described in the following claims.

What is claimed is:

1. An interfolding apparatus for interfolding sheets cut sequentially from a single web of material, the apparatus comprising:

a knife roll rotatable about an axis and operable to cut successive sheets from a stream of the single web of material issuing from a source in a downstream direction;

a folding roll positioned downstream of the knife roll, the folding roll rotatable in a first direction at a first roll speed; and an additional roll disposed adjacent to the folding roll and rotatable about an axis in a second direction at a second roll speed, the additional roll operable to receive the successive sheets and release the successive sheets in the downstream direction toward the folding roll;

wherein the folding roll and the additional roll define a nip therebetween, the successive sheets passing through the nip, and wherein the first roll speed of the folding roll is different from the second roll speed of the additional roll, the difference in speed between the folding roll and the additional roll operable to overlap adjacent portions of the successive sheets cut from the single web of material onto the folding roll.

2. The apparatus of claim 1, wherein the folding roll includes a plurality of grippers, and a plurality of tuckers.

3. The apparatus of claim 1, wherein the folding roll has a first roll speed approximately equal to ⅔ of the second roll speed of the additional roll.

4. The apparatus of claim 1, wherein the additional roll adjacent the folding roll is a lap roll, and wherein the lap roll includes a plurality of vacuum ports and a plurality of relief areas.

5. The apparatus of claim 4, wherein each of the plurality of relief areas is configured to receive a portion of one of the successive sheets during transfer of the one of the successive sheets from the lap roll to the folding roll.

6. The apparatus of claim 4, wherein the plurality of vacuum ports are spaced about a circumference of the lap roll to ensure contact between the lap roll and at least a portion of the sheets as the sheets pass through the nip between the lap roll and the folding roll.

7. The apparatus of claim 4, wherein the folding roll includes at least one vacuum port such that as the sheets pass through the nip between the lap roll and the folding roll, a leading edge of the sheets is transferred from the lap roll to the folding roll and is held on the folding roll by one of the at least one vacuum port of the folding roll.

8. The apparatus of claim 7, wherein a remaining portion of the sheet is held onto the lap roll by the plurality of vacuum ports of the lap roll as the sheets pass through the nip, and wherein the difference in roll speed between the folding roll and the lap roll creates slack in the sheet between the leading edge and the trailing portion.

9. The apparatus of claim 1, further comprising a tail roll disposed adjacent the folding roll to define a nip therebetween.

10. The apparatus of claim 9, wherein the folding roll includes at least one tucker and the tail roll includes at least one relief area, the tucker forcing a portion of a sheet within the relief area during rotation of the folding roll to form a bend in the sheet.

11. A method for interfolding sheets cut sequentially from a single web of material, the method comprising:

issuing a single web of material in a downstream direction from a source;

cutting with a knife roll the stream of web material into successive sheets following substantially the same path during interfolding;

rotating an additional roll at a first roll speed;

transferring each sheet to the additional roll;

rotating a folding roll at a second roll speed;

transferring each sheet to the folding roll;

slowing the sheet with the folding roll, overlapping adjacent portions of the successive sheets onto the folding roll; and interfolding the overlapped sheets.

12. The method of claim 11, wherein slowing the sheet with the folding roll includes slowing the sheet to ⅔ the first roll speed of the additional roll.

13. The method of claim 11, wherein transferring each sheet to the folding roll includes applying a vacuum to a leading edge of the sheet with a folding roll vacuum port, and applying a vacuum to a trailing portion of the sheet with multiple additional roll vacuum ports.

14. The method of claim 11, further comprising applying a vacuum to a leading edge of the sheet transferred to the folding roll via a single vacuum port.

15. The method of claim 14, further comprising applying a vacuum to a remaining portion of the sheet such that the remaining portion of the sheet is held onto the additional roll.

16. The method of claim 11, further comprising providing a tail roll adjacent the folding roll to define a nip therebetween.

17. The method of claim 16, further comprising providing at least one tucker on the folding roll and providing at least one relief area on the tail roll, the tucker forcing a portion of a sheet within the relief portion during rotation of the folding roll to form a bend in the sheet.

18. An interfolding apparatus, for interfolding sheets cut sequentially from a single web of material, comprising:

a knife roll rotatable about an axis and operable to cut sheets from a stream of the single web of material issuing from a source in a downstream direction;

a folding roll positioned downstream of the knife roll and adapted to receive the sheets, the folding roll rotatable in a first direction; and a lap roll adjacent the folding roll rotatable about an axis in a second direction, the lap and folding roll defining a nip therebetween;

wherein the sheets are directly transferred from the lap roll to the folding roll to overlap adjacent portions of successive sheets cut from the single web of material onto the folding roll.

19. The apparatus of claim 18, further comprising a tail roll disposed adjacent the folding roll, the tail roll and folding roll defining a second nip therebetween.

20. The apparatus of claim 19, wherein the folding roll includes at least one tucker and the tail roll includes at least one relief area, the tucker forcing a portion of a sheet within the relief area during rotation of the folding roll to form a bend in the sheet.

21. The apparatus of claim 18, wherein the folding roll rotates at a first roll speed, and wherein the lap roll rotates at a second roll speed, the first roll speed being slower than the second roll speed.

22. The apparatus of claim 21, wherein the first roll speed is approximately equal to ⅔ of the second roll speed.

23. The apparatus of claim 21, wherein the difference between the first and second roll speeds results in an overlap between adjacent portions of successive sheets.

24. The apparatus of claim 18, wherein the folding roll includes a plurality of grippers and a plurality of tuckers.

25. The apparatus of claim 24, wherein the lap roll includes a plurality of vacuum ports and a plurality of relief areas.

26. The apparatus of claim 25, wherein each of the plurality of relief areas is configured to receive a portion of a sheet during transfer of the sheet from the lap roll to the folding roll.

27. The apparatus of claim 18, wherein the folding roll includes at least one vacuum port such that as sheets pass through the nip between the lap roll and the folding roll, a leading edge of the sheets is transferred from the lap roll to the folding roll and is held onto the folding roll by one of the at least one vacuum port of the folding roll.

28. The apparatus of claim 27, wherein a remaining portion of the sheet is held onto the lap roll by a plurality of vacuum ports of the lap roll as the sheets pass through the nip, and wherein slack is created in the sheet between the leading edge and tailing portion as the sheets pass through the nip.

29. A method for interfolding sheets cut sequentially from a single web of material the method comprising:

issuing a single web of material in a downstream direction from a source;

cutting with a knife roll the stream of web material into successive sheets which successively follow substantially the same path during interfolding;

transferring each sheet to a rotating lap roll;

transferring each sheet directly from the lap roll to a rotating folding roll;

overlapping a trailing edge of a first sheet with a leading edge of a second successive sheet on the folding roll; and interfolding the overlapped sheets.

30. The method of claim 29, wherein transferring each sheet to the rotating folding roll includes slowing the sheet.

31. The method of claim 30, wherein slowing the sheet with the folding roll includes slowing the sheet to ⅔ the first speed of the lap roll.

32. The method of claim 29, wherein transferring each sheet to a lap roll includes applying a vacuum to a leading edge of the sheet with a folding roll vacuum port, and applying a vacuum to a trailing portion of the sheet with multiple lap roll vacuum ports.

33. The method of claim 32, further comprising applying a vacuum to a leading edge of the sheet transferred to the folding roll via a single vacuum port.

34. The method of claim 32, further comprising applying a vacuum to a remaining portion of the sheet such that the remaining portion of the sheet is held onto the lap roll.

35. The method of claim 29, further comprising providing a tail roll adjacent the folding roll to define a nip therebetween, and rotating the tail roll to roll the overlapped sheets through the nip.

36. The method of claim 35, further comprising providing at least one tucker on the folding roll and providing at least one relief area on the tail roll, the tucker forcing a portion of a sheet within the relief portion during rotation of the folding roll and tail roll to form a bend in the sheet.

* * * * *